US009124976B2

(12) United States Patent
Chu et al.

(10) Patent No.: US 9,124,976 B2
(45) Date of Patent: Sep. 1, 2015

(54) TREBLE AND BASS HEADPHONE STRUCTURE

(71) Applicant: Eastern Technologies Holding Limited, Grand Cayman (KY)

(72) Inventors: Ming-Chung Chu, New Taipei (TW); Pin-Tang Lee, New Taipei (TW)

(73) Assignee: EASTERN TECHNOLOGIES HOLDING LIMITED, Grand Cayman (KY)

( * ) Notice: Subject to any disclaimer, the term of this patent is extended or adjusted under 35 U.S.C. 154(b) by 121 days.

(21) Appl. No.: 14/159,920

(22) Filed: Jan. 21, 2014

(65) Prior Publication Data

US 2015/0208160 A1 Jul. 23, 2015

(51) Int. Cl.
*H04R 25/00* (2006.01)
*H04R 1/10* (2006.01)

(52) U.S. Cl.
CPC ..... *H04R 1/1058* (2013.01)

(58) Field of Classification Search
CPC ..... H03F 1/526; H03F 1/542; H04R 1/02; H04R 1/021; H04R 1/1008; H04R 1/1016; H04R 1/1058; H04R 1/1066; H04R 1/1075; H04R 1/105; H04R 3/12; H04R 5/033; H04R 5/0335
USPC ..... 381/182, 184, 370, 371, 381
See application file for complete search history.

(56) References Cited

U.S. PATENT DOCUMENTS 7,340,071 B2 * 3/2008 Huang ..... 381/371

OTHER PUBLICATIONS

WO 2010/007440, Strong et al. Jan. 21, 2010.*

* cited by examiner

*Primary Examiner* — Brian Ensey
(74) *Attorney, Agent, or Firm* — Ming Chow; Sinorica, LLC

(57) ABSTRACT

A treble and bass headphone structure comprises: a headphone back cover; a headphone support frame contacted with the headphone back cover; a dynamic bass sound unit contacted with the headphone back cover; a partition contacted with the dynamic bass sound unit; a headphone front cover contacted with the partition; a film ribbon tweeter sound unit entered and accommodated in an accommodating slot of the headphone front cover from the headphone front cover; and a soft ear-cover contacted with the headphone front cover; wherein the headphone front cover covers up the headphone back cover.

5 Claims, 7 Drawing Sheets

TREBLE AND BASS HEADPHONE STRUCTURE

BACKGROUND OF THE INVENTION

1. Field of the Invention

The present invention generally relates to a treble and bass headphone structure, more particularly to a treble and bass headphone structure that simultaneously has a high-pitched sound unit and a low-pitched sound unit.

2. Description of the Prior Art

The Fleming's left-hand rule is now applied to the dynamic sound unit of a current headphone, that is, a current wire and a magnetic line are disposed between the north pole and south pole of a magnet, so that the current wire will be moved due to the magnetic line and current. Continuously, a diaphragm is placed on the current wire and the diaphragm may be move back and forth due to varied current.

The diaphragm of a ribbon tweeter sound unit is consisted of a tiny metal coil and a plastic thin plate. Current in the tiny metal coil works in coordination with magnetism so as to vibrate the metal coil, and then to emit high-frequency sounds. Due to the light weight of the tiny metal coil, such high-frequency sounds respond very quickly after the metal coil is vibrated.

Please refer to FIG. 6 and FIG. 7, which illustrate a schematic partial 3-D exploded view of a headphone structure in prior arts and a schematic sectional view of a headphone structure in prior arts. As shown in figures, the prior art headphone structure includes a headphone back cover 1', a headphone support frame 2', a dynamic bass sound unit 3', a headphone front cover 5', a soft ear-cover 7', and a plurality of channel holes 10', wherein the headphone support frame 2' is connected with the headphone back cover 1', the headphone front cover 5' covers on the headphone back cover 1', the dynamic bass sound unit 3' is installed on the headphone front cover 5', the headphone front cover 5' is wrapped around the soft ear-cover 7', the plurality of channel holes 10' are disposed on the surface of the headphone front cover 5', and only one single dynamic bass sound unit 3' is installed in the headphone back cover 1'. For a better sound quality, to perform strong bass may lose some alt. Besides, there is another consideration of adding a dynamic sound unit. The dynamic sound unit may compress the air in the prior art headphone structure due to a push-pull motion of the dynamic sound unit. However, two or more dynamic sound units may interfere with each other. As a conclusion, how to design a headphone structure in order to solve the problem of the interference is an important issue to the people skilled in the art.

SUMMARY OF THE INVENTION

The main objective of the present invention is to provide a treble and bass headphone structure. The present invention simultaneously has a high-pitched sound unit and a low-pitched sound unit so as to perform well in the aspect of purified sound, but without noise.

To achieve the above objective, the treble and bass headphone structure comprises: a headphone back cover; a headphone support frame, which is connected with an external portion of the headphone back cover; a dynamic bass sound unit, a first surface of the dynamic bass sound unit is contacted with an inner portion of the headphone back cover; a partition, a first surface of the partition is contacted with a second surface of the dynamic bass sound unit, the second surface of the dynamic bass sound unit and the first surface of the dynamic bass sound unit are opposite to each other; a headphone front cover, a first surface of the headphone front cover is contacted with a second surface of the partition, the second surface of the partition and the first surface of the partition are opposite to each other; a film ribbon tweeter sound unit, which is entered and accommodated in an accommodating slot of the headphone front cover from the first surface of the headphone front cover, the film ribbon tweeter sound unit is exposed to a second surface of the headphone front cover, the second surface of the headphone front cover and the first surface of the headphone front cover are opposite to each other; and a soft ear-cover, an inner surface of the soft ear-cover is contacted with the second surface of the headphone front cover; wherein the first surface of the headphone front cover covers up the inner portion of the headphone back cover.

The first surface of the headphone front cover has a plurality of sound channel holes.

A plurality of sound-vent channels are formed among the inner portion of the headphone back cover, the first surface of the partition, and the plurality of sound channel holes.

The second surface of the headphone front cover has a plurality of bass channel holes.

A plurality of bass channels are formed among an inner surface of the second surface of the headphone front cover, the plurality of bass channel holes, and the second surface of the partition.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
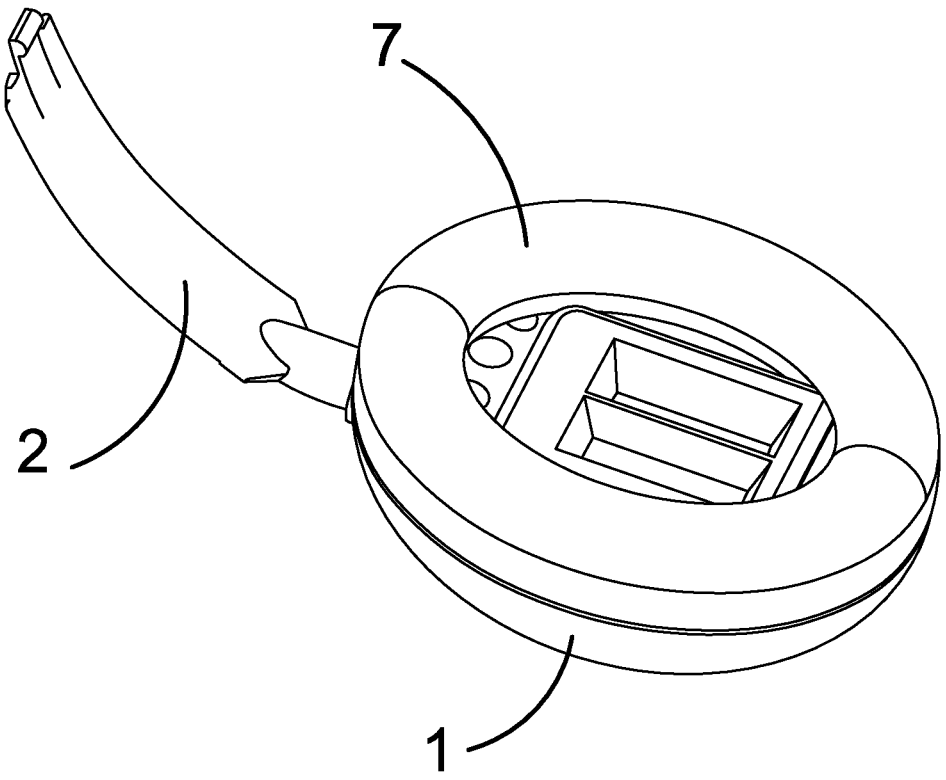
FIG. 1 illustrates a schematic 3-D view of the treble and bass headphone structure of the present invention.
Figure 2:
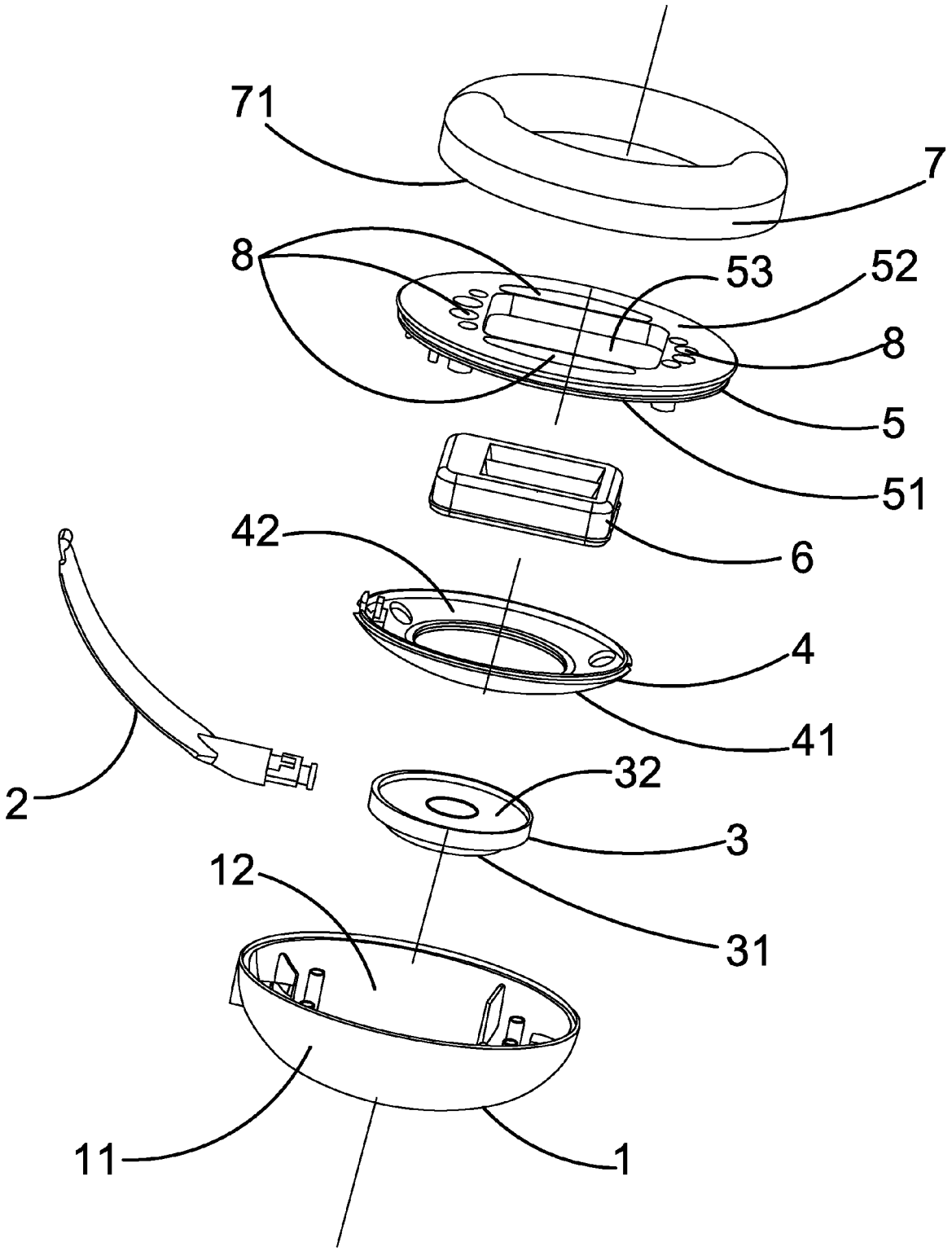
FIG. 2 illustrates a schematic 3-D exploded view of the treble and bass headphone structure of the present invention.

Please refer to FIG. 1 and FIG. 2, which illustrate a schematic 3-D view of the treble and bass headphone structure of the present invention and a schematic 3-D exploded view of the treble and bass headphone structure of the present invention. The treble and bass headphone structure includes a headphone back cover 1; a headphone support frame 2, which is connected with an external portion 11 of the headphone back cover 1; a dynamic bass sound unit 3, a first surface 31 of the dynamic bass sound unit 3 is contacted with an inner portion 12 of the headphone back cover 1; a partition 4, a first surface 41 of the partition 4 is contacted with a second surface 32 of the dynamic bass sound unit 3, the second surface 32 of the dynamic bass sound unit 3 and the first surface 31 of the dynamic bass sound unit 3 are opposite to each other; a headphone front cover 5, a first surface 51 of the headphone front cover 5 is contacted with a second surface 42 of the partition 4, the second surface 42 of the partition 4 and the first surface 41 of the partition 4 are opposite to each other; a film ribbon tweeter sound unit 6, which is entered and accommodated in an accommodating slot 53 of the headphone front cover 5 from the first surface 51 of the headphone front cover 5, the film ribbon tweeter sound unit 6 is exposed to a second surface 52 of the headphone front cover 5, the second surface 52 of the headphone front cover 5 and the first surface 51 of the headphone front cover 5 are opposite to each other; and a soft ear-cover 7, an inner surface 71 of the soft ear-cover 7 being contacted with the second surface 52 of the headphone front cover 5; wherein the first surface 51 of the headphone front cover 5 covers up the inner portion 12 of the headphone back cover 1.

Figure 3:
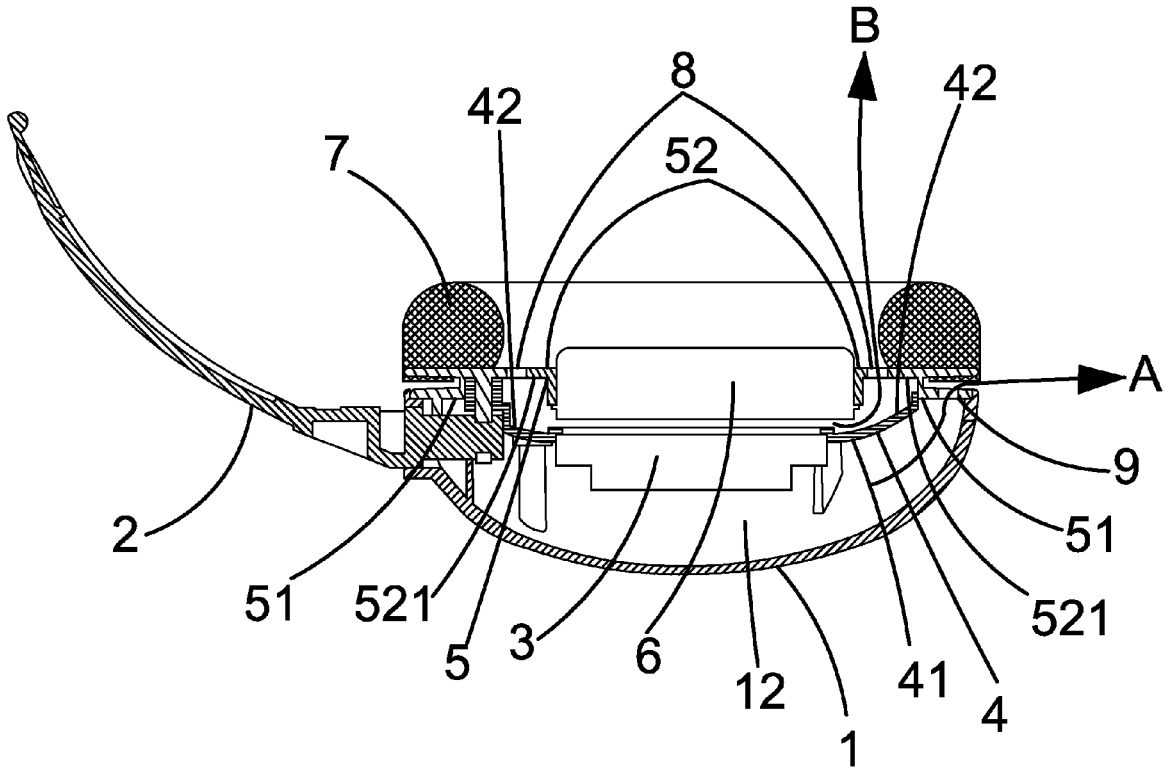
FIG. 3 illustrates a schematic assembled sectional view of the treble and bass headphone structure of the present invention.
Figure 5:
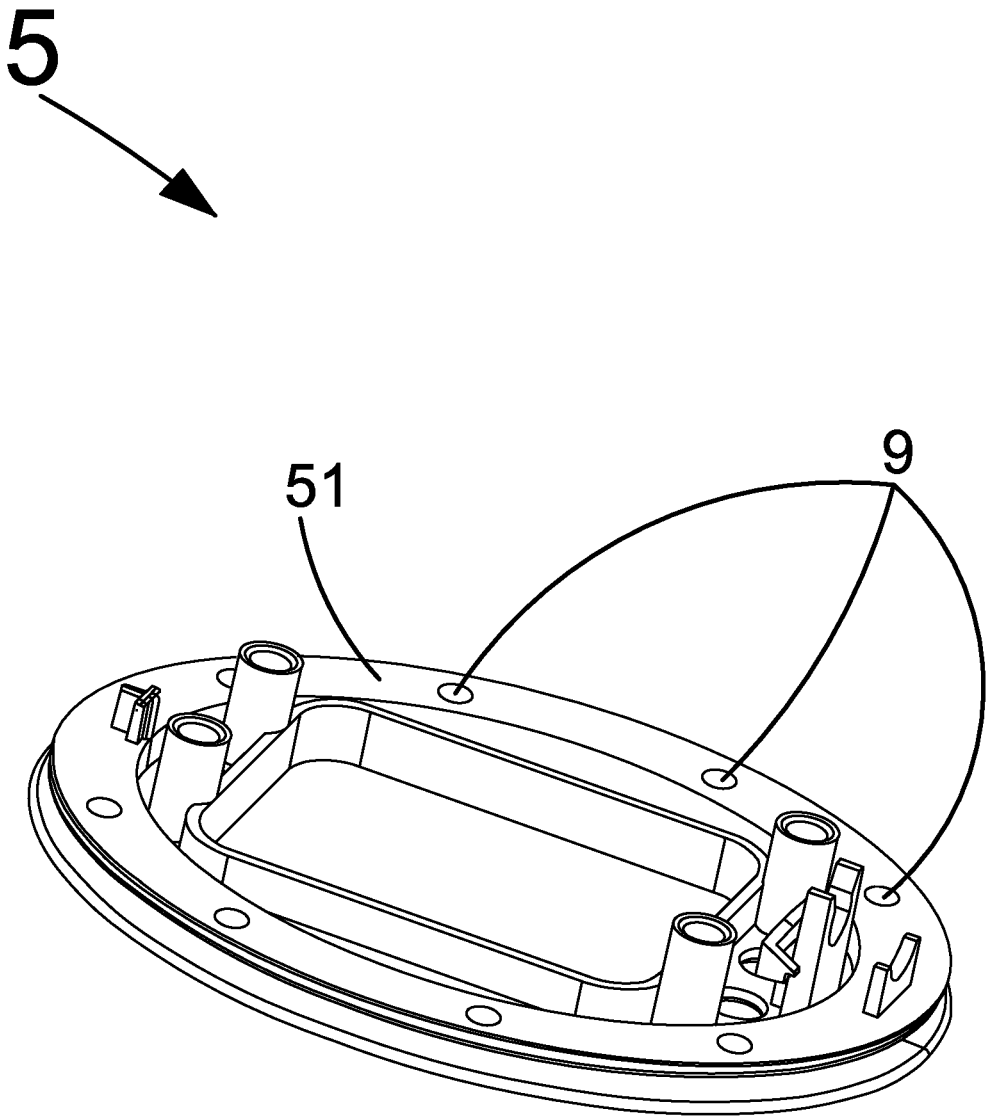
FIG. 5 illustrates a schematic 3-D view of a headphone front cover of the treble and bass headphone structure.
Figure 6:
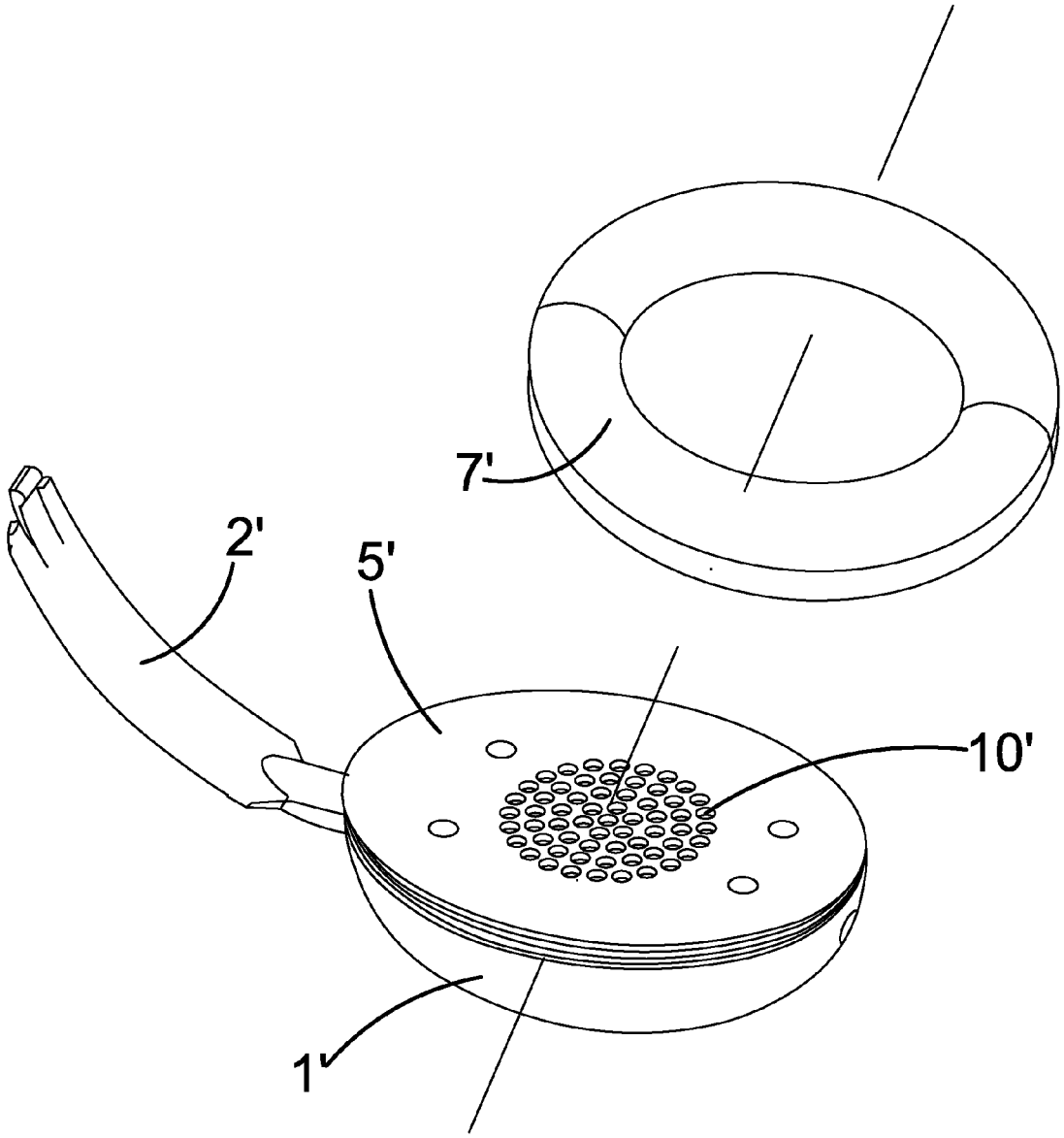
Fig. 6 Prior Art
FIG. 6 illustrates a schematic partial 3-D exploded view of a headphone structure in prior arts.
Figure 7:
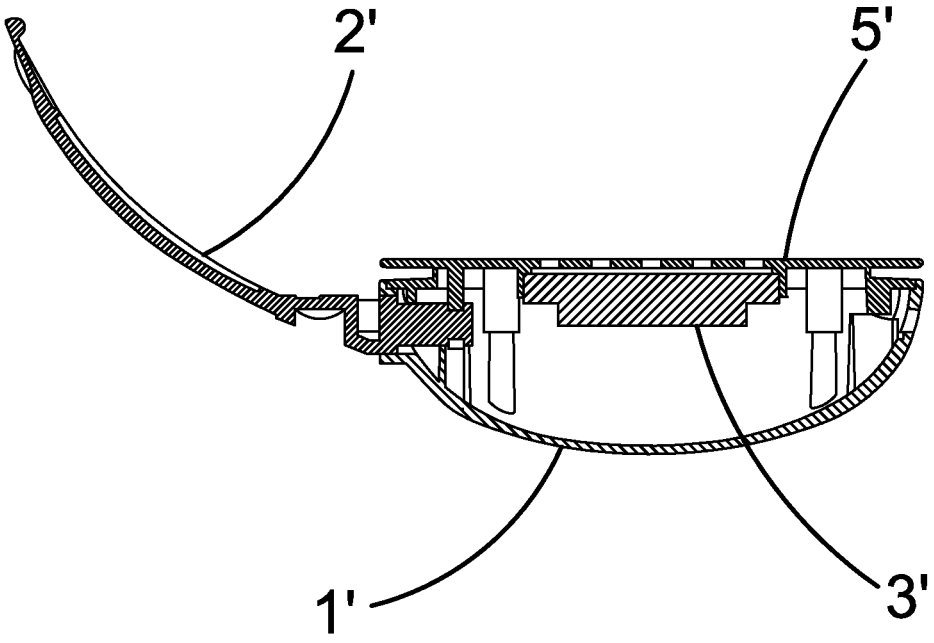
Fig. 7 Prior Art
FIG. 7 illustrates a schematic sectional view of a headphone structure in prior arts.

Please refer to FIG. 3 and FIG. 5, which illustrate a schematic assembled sectional view of the treble and bass headphone structure of the present invention and a schematic 3-D view of the headphone front cover of the treble and bass headphone structure of the present invention. As shown in FIG. 5, the first surface 51 of the headphone front cover 5 has a plurality of sound channel holes 9. As shown in FIG. 3, a plurality of sound-vent channels A are formed among the inner portion 12 of the headphone back cover 1, the first surface 41 of the partition 4, and the plurality of sound channel holes 9; further, the second surface 52 of the headphone front cover 5 has a plurality of bass channel holes 8, and a plurality of bass channels B are formed among an inner surface 521 of the second surface 52 of the headphone front cover 5, the plurality of bass channel holes 8, and the second surface 42 of the partition 4.

Figure 4:
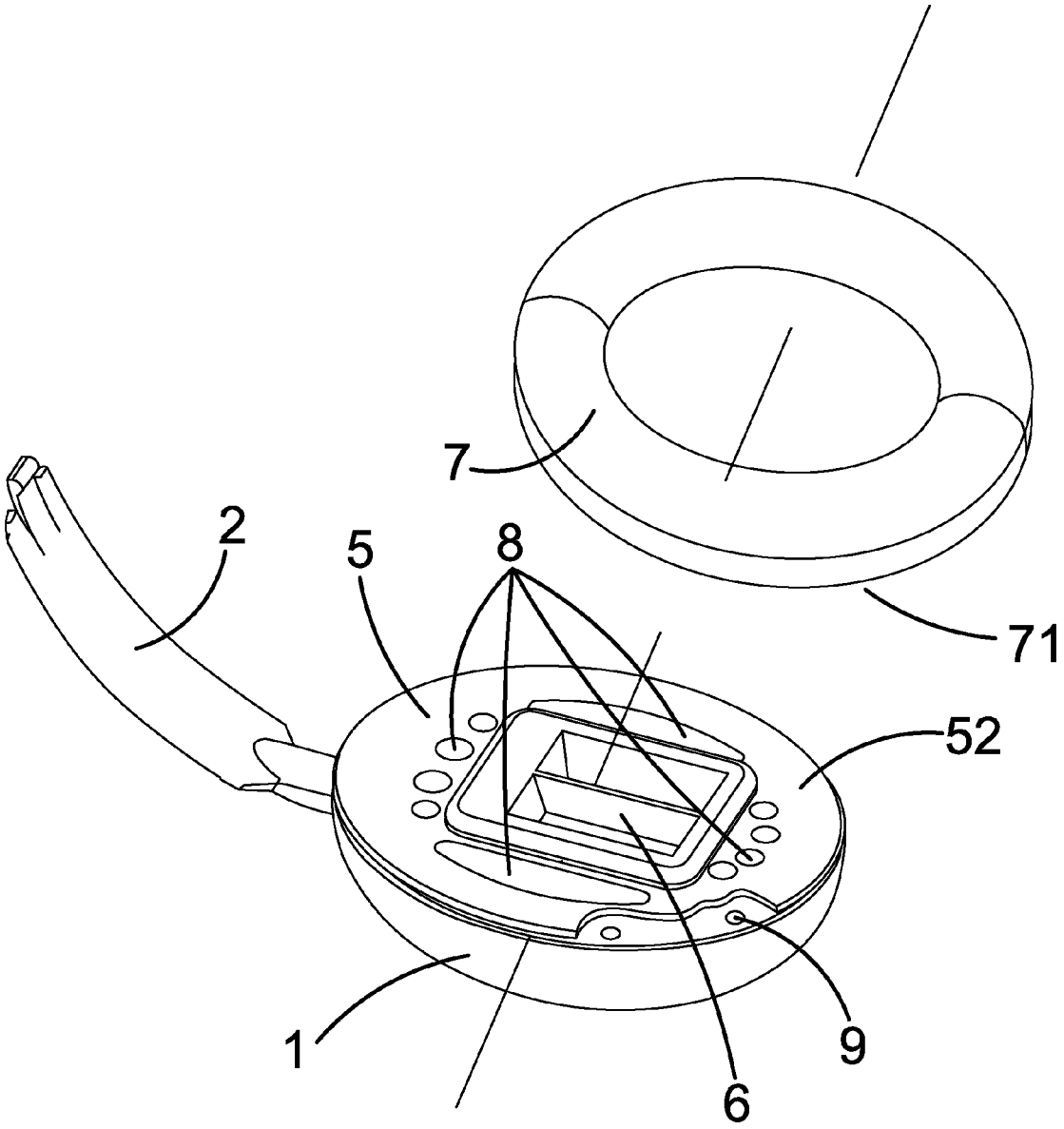
FIG. 4 illustrates a schematic partial 3-D exploded view of the treble and bass headphone structure of the present invention.

For more detail, please again refer to FIG. 4, which illustrates a schematic partial 3-D exploded view of the treble and bass headphone structure of the present invention. The film ribbon tweeter sound unit 6 is installed on the headphone front cover 5, and the plurality of bass channel holes 8 are distributed around the film ribbon tweeter sound unit 6. Then, the inner surface 71 of the soft ear-cover 7 is integrated with the second surface 52 of the headphone front cover 5, in order to complete the whole treble and bass headphone structure.

Please again refer to FIG. 3, the present invention mainly features that of simultaneously having the film ribbon tweeter sound unit 6 and the dynamic bass sound unit 3.

High-pitched sound issued from the film ribbon tweeter sound unit 6 directly goes into the soft ear-cover 7 and then spreads out; low-pitched sound issued from the dynamic bass sound unit 3 goes into the soft ear-cover 7 through the plurality of bass channels B and the plurality of bass channel holes 8 and then spreads out. In addition, noise may also be excluded via the plurality of sound channel holes 9 and the plurality of sound-vent channels A. As a conclusion, the present invention performs well in the aspect of purified sound via the film ribbon tweeter sound unit 6 and the dynamic bass sound unit 3, but without noise.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A treble and bass headphone structure, comprising:

a headphone back cover;

a headphone support frame, which is contacted with an external portion of the headphone back cover;

a dynamic bass sound unit, a first surface of the dynamic bass sound unit being contacted with an inner portion of the headphone back cover;

a partition, a first surface of the partition being contacted with a second surface of the dynamic bass sound unit, the second surface of the dynamic bass sound unit and the first surface of the dynamic bass sound unit being opposite to each other;

a headphone front cover, a first surface of the headphone front cover being contacted with a second surface of the partition, the second surface of the partition and the first surface of the partition being opposite to each other;

a film ribbon tweeter sound unit, which is entered and accommodated in an accommodating slot of the headphone front cover from the first surface of the headphone front cover, the film ribbon tweeter sound unit being exposed to a second surface of the headphone front cover, the second surface of the headphone front cover and the first surface of the headphone front cover being opposite to each other; and a soft ear-cover, an inner surface of the soft ear-cover being contacted with the second surface of the headphone front cover;

wherein the first surface of the headphone front cover covers up the inner portion of the headphone back cover.

2. The treble and bass headphone structure according to claim 1, wherein the first surface of the headphone front cover has a plurality of sound channel holes.

3. The treble and bass headphone structure according to claim 2, wherein a plurality of sound-vent channels are formed among the inner portion of the headphone back cover, the first surface of the partition, and the plurality of sound channel holes.

4. The treble and bass headphone structure according to claim 2, wherein the second surface of the headphone front cover has a plurality of bass channel holes.

5. The treble and bass headphone structure according to claim 4, wherein a plurality of bass channels are formed among an inner surface of the second surface of the headphone front cover, the plurality of bass channel holes, and the second surface of the partition.

* * * * *